US005904209A

United States Patent [19]

Kenworthy et al.

[11] Patent Number: 5,904,209

[45] Date of Patent: May 18, 1999

[54] METHOD AND DEVICE FOR REMOVAL OF PRODUCTION INHIBITING LIQUID FROM A GAS WELL

[75] Inventors: Michael W. Kenworthy, New York; Boris Ganelin, Brooklyn, both of N.Y.

[73] Assignee: Technology Commercialization Corp., New York, N.Y.

[21] Appl. No.: 09/179,163

[22] Filed: Oct. 26, 1998

[51] Int. Cl.[6] ..... E21B 43/00

[52] U.S. Cl. ..... 166/372; 166/242.3

[58] Field of Search ..... 166/369, 372, 166/54.1, 242.3, 242.5

[56] References Cited

U.S. PATENT DOCUMENTS 5,634,522 6/1997 Hershberger ..... 166/372
5,671,813 9/1997 Lima ..... 166/372
5,730,220 3/1998 Ganelin ..... 166/242.3

*Primary Examiner*—William Neuder
*Attorney, Agent, or Firm*—Boris Leschinsky

[57] ABSTRACT

A method and device for removal of production inhibiting liquid from a gas well, wherein a tubing string is placed inside the well to form a fluid communication path from the liquid accumulation zone near the bottom of the well to the ground surface. The diameter of the tubing string is sufficiently small (preferably between 1/16 and ½ inch) so as to define a high liquid-to-gas ratio two-phase flow, preferably capillary bubble flow along the tubing string in order to maximize the liquid head and minimize the gas loss in this tubing string, and to reduce or eliminate the additional restriction along the main gas production tubing generally associated with the presence of such tubing string. In some embodiments, the tubing string comprises a plurality of individual tubing channels for increased rate of liquid removal, each channel being of sufficiently small size so as to define a capillary bubble flow.

15 Claims, 7 Drawing Sheets

METHOD AND DEVICE FOR REMOVAL OF PRODUCTION INHIBITING LIQUID FROM A GAS WELL

BACKGROUND OF THE INVENTION

1. Field of the Invention

The present invention relates generally to oil and gas flow production. In particular, a method and device according to the invention relates to a system for removal of accumulated liquid inhibiting the flow of gas producing wells.

2. Description of the prior art

Many gas wells produce liquids in addition to gas. These liquids include water, oil, and condensate. As described in the paper SPE 2198 of the Society of Petroleum Engineers of AIME, authored by R. G. Turner, A. E. Dukler, and M. G. Hubbard, "in many instances, gas phase hydrocarbons produced from underground reservoirs will have liquid-phase material associated with them, the presence of which can effect the flowing characteristics of the well. Liquids can come from condensation of hydrocarbon gas (condensate) or from interstitial water in the reservoir matrix. In either case, the higher density liquid phase, being essentially discontinuous, must be transported to the surface by the gas. In the event the gas phase does not provide sufficient transport energy to lift the liquids out of the well, the liquid will accumulate in the well bore. The accumulation of the liquid will impose an additional back pressure on the formation and can significantly affect the production capacity of the well". Over time, accumulated liquid can cause a complete blockage and provoke premature abandonment of the well. Removal of such liquid would restore the flow of gas and improve utilization and productivity of a gas well.

In essence, a two-phase flow usually exists in the well sometimes even at the beginning of its life. High pressure gas flow violently mixes with liquid droplets and moves them up the well with sufficient energy so as to remove the liquid out of formation or, at least to force the liquid droplets out of the upwardly moving stream of gas so as not to present any substantial flow resistance. In this two-phase flow, liquid-to-gas ratio is quite low and flow conditions are favorable for liquid removal. Well diameter and depth, gas pressure at the bottom and at the top of the well, and temperature are among the factors determining the flow structure and the resulting amount of liquid removal. Even in the case of some liquid accumulation, the gas pressure is still high enough to overcome the back pressure exerted by liquids and gas is produced up the well, albeit at a lower rate than if there were no accumulated liquid.

Over time, however, as the gas pressure in the formation declines and liquid invasion increases at the wellbore, the flow conditions may change. The mist flow transforms into an annular flow where the liquid runs up the casing wall and liquid droplets are entrained in the gas flow. As the pressure continues to decline, the annular flow loses its ability to move the liquid up and the droplets of liquid are forced against the wall of the gas casing rather then being removed out of the well. As the liquid tends to slide down to the bottom of the well in a falling film pattern, it accumulates in the lower sections of the well forming a liquid column. This column eventually develops a substantial height so as to increase the resistance to the gas flow. Often, accumulation of as little as 5 to 25 barrels of liquid a day may cause this effect. The two-phase flow conditions cease to exist and ultimately the liquid column completely blocks the gas from flowing upward.

There are many technical solutions that have been suggested in the prior art to solve the problem of accumulating liquids. Some of them are described briefly by E. J. Hutlas and W. R. Granberry in the article entitled "A Practical Approach to Removing Gas Well Liquids" in the Journal of Petroleum Technology, August 1972, p. 916–922. As the authors point out, sometimes wells are blown periodically to remove liquids along with thus very rapidly produced gas. In other cases, siphon tubing strings are run down the well and the pumper unloads the liquids from the well by opening such siphon tubing strings from time to time to atmospheric pressure. This siphon tubing string may have a typical diameter of 1 to 1 ¼ inch. Such system requires sometimes that the main flow is interrupted and even then the pressure at the bottom may not be enough to cause the liquid to flow through a smaller tube.

Occasional or permanent increase of the wellbore pressure was proposed to be used in order to ensure the formation of a favorable two-phase flow in the whole casing or at least in a smaller diameter liquid removal tube. A method and system for such periodic dewatering of a gas well is described in U.S. Pat. No. 4,226,284 by Evans. The flow through the casing is periodically shut off to increase the wellbore pressure so the water or other liquids can be blown off through the smaller liquid removal tube and into the main outlet together with some gas for further separation downstream. Alternately, the U.S. Pat. No. 5,211,242 describes a liquid removal chamber disposed at the bottom of the well with two tubing strings connecting the chamber with the top of the well. One tubing string is used to raise the pressure in the chamber while the other provides the flow path for liquid removal.

Various other injections are used for this purpose. U.S. Pat. No. 4,410,041 by Davies describes injection of a aqueous liquid solution which generates high pressure nitrogen gas. U.S. Pat. No. 4,276,935 by Hessert describes injection of a hydrocarbon-diluted water-in-oil emulsion comprising a viscosifying polymer such as polyacrylamide, the injected polymer swelling on contact with connate water to restrict transfer of water toward the producing gas well. U.S. Pat. No. 5,244,043 by Shuler discloses the injection of controlled quantities of a scaling cation brine and scaling anion brine such that the scale will precipitate, while the well is temporarily shut down, to reduce the permeability of the formation and prevent liquid from coming into vicinity of the well.

Injection of a foaming agent is proposed in U.S. Pat. No. 4,237,977 by Lutener as means to improve liquid removal conditions. Similar solution is contained in the U.S. Pat. No. 5,515,924 by Osterhoudt, whereby a solid stick is inserted into a well consisting of surfactant/chemical solution. This soap stick falls to the bottom of the well and transforms the liquid into a foam thus affecting favorably the conditions for liquid removal. All of the above solutions require additional complicated means to be available and procedures to be performed in order to influence the conditions forming a two-phase flow with high concentrations of liquid such as to promote its removal from the well. Also, the chemical additives often require separation in surface facilities prior to water disposal or condensate refining.

Mechanical water removal systems are also known in the prior art. U.S. Pat. No. 4,275,790 by Abercrombie discloses a water removal approach wherein the well contains a tubing string located inside the casing, with the tubing in contact with the accumulated liquid. Both the tubing and the casing are connected to the offlake line. Periodically, both the tubing and the casing flow are turned off so that the pressure in the wellbore is allowed to build up. Then, the tubing is opened to the offtake line that allows liquid to be discharged for further separation downstream.

A split-stream method for liquid removal from wells with low formation pressure is described in U.S. Pat. No. 4,509,599 by Chenoweth, wherein a compressor is employed to pump gas from a tubing string pathway disposed in the gas well to a gas pathway which runs up the annulus, thus unloading liquids from near the bottom of the well via the tubing pathway.

Finally, U.S. Pat. No. 5,636,693 by Elmer describes yet another tubing string system where both the tubing and the main casing are connected to the offtake line and having at least one choke means. The choke means preferably positioned in the casing annulus is used to control pressure in the tubing string and thus control liquid removal by increasing gas velocity up the tubing string to allow liquid mist to exit the well.

Most of the above prior art solutions fail to address directly the main phenomenon which causes liquid accumulation in the well in the first place. As described above, typically at the beginning of the well life, the diameter of the casing is sufficiently large to allow for both the high flow rate of gas needed for economically viable utilization of the well and, at the same time for such conditions of the gas and liquid two-phase flow so as to remove liquid from the well. With time, however, as the pressure declines and liquid invasion at the wellbore increases, two-phase flow conditions change, allowing the gas to slip by the liquid due to its lower density and viscosity. As this slippage increases, the liquid is ultimately left behind accumulating along the outer walls of the casing and moving down the well where it accumulates. Theoretically, it would be desirable to reduce the diameter of the casing in which case the slippage of gas past the liquid can be reduced. In fact, it was proposed to retrofit older wells with smaller diameter casings. However this would reduce the gas flow rate which eventually makes the well economically undesirable. Thus, the tubing string concept was proposed in the prior art to address the diameter question. Even though the diameter of the string is lower than the diameter of the well, it is still typically more then 1 or 1 ¼ inch which is considered necessary for sufficient rate of liquid removal. In addition to reducing the useful cross-section area of the main gas annulus and impeding the gas flow, in many cases this diameter still does not provide a sufficiently high liquid-to-gas ratio and associated low gas slippage and therefore for efficient liquid removal. Typically, these velocity strings depend on using the velocity of the gas liquid flow to entrain the liquid in the gas to reach the top of the well. Since high volume of gas is flowing up this tubing string, it has to be connected to the main offtake line or, alternately the gas has to be compressed before it is reintroduced downstream, where both of these options reduce system flexibility, demand more equipment to be used and increase production costs.

Therefore, the need exists for a liquid removal system with intrinsically high liquid-to-gas ratio for efficient liquid removal which is flexible in design to accommodate various well conditions, does not require gas flow interruptions, and occupies minimum space in the gas production conduit (casing or production tubing) so as not to reduce significantly the gas flow rate.

SUMMARY OF THE INVENTION

Accordingly, it is an object of the present invention to overcome these and other drawbacks of the prior art by providing a novel method and device for removal of production inhibiting liquid from a gas well. In one embodiment, the invention utilizes a small diameter tubing string placed inside the gas production tubing and in fluid communication with the liquid to be removed. In this embodiment, the exit of this small diameter tubing string at the surface is outside of the well production tubing and casing to allow separate control of its flow rate and exit pressure. The diameter of the tubing string is small enough so as to allow for a high liquid-to-gas ratio two-phase flow to form in the string which creates favorable conditions for economical liquid removal. This diameter is designed to be below 1 inch and preferably between 1/16 and ½ of an inch. In case of such small diameter tubing string being used, capillary bubble flow conditions are formed from the bottom and at least through a significant portion of that tubing string and gas can not slip significantly past the liquid on its way up to the top of the well. In the upper regions of this small diameter tubing string, due to the significant expansion of the gas phase and the associated increase in velocity of the flow, the capillary bubble flow may transform into a churn flow or annular flow regime. Even with the development of a chum flow or annular flow regime, the efficiency of the gas phase energy being transferred to the liquid is increased with the small diameter tubing due to the higher interfacial contact between the phases, resulting in greater interfacial shear stress and increased liquid entrainment. Since only a small amount of gas would be produced through this tubing string, it may not be economically worthwhile to separate the gas from the liquid and compress it to reintroduce back into the main offtake line. Additionally, due to the significant increase in height of the liquid resulting from this capillary bubble flow regime, the pressure at the surface outlet of this small diameter tubing may be equal to or higher than the main offtake line downstream from the choke used to control the rate of gas production in the main production tubing. Preferably, the flow through this small diameter tubing string would be continuous, flowing simultaneously with the flow through the main production tubing to always minimize any liquid accumulation at the bottom of the production tubing and therefore maximize the gas production flow rate.

It is another object of the present invention to provide a device for liquid removal with higher liquid removal rate while preserving the high liquid-to-gas ratio. Multiple small diameter tubes are used to boost up the liquid removal flow rate while preserving all of the cited benefits of the capillary bubble flow regime. Each tube has the diameter of less than 1 inch and preferably between 1/16 and ½ of an inch.

It is yet another object of the present invention to provide a tubing string to form a parallel pathway for liquid to be lifted to the top of the well. In another embodiment of the invention, the exit of the small diameter tubing string is opened into the top of the main gas production tubing or gas producing annulus so that while the string contains the high liquid-to-gas ratio flow, the main gas production tubing or annulus contains uninterrupted gas production flow with minimum liquid present.

It is a further objective of the invention to provide a liquid removal system without additional restrictions to the main gas flow. In yet another embodiment of the invention, the liquid removal tubing string is located inside the well casing but outside the gas production main tubing. In this case, the tubing string entrance is located below the well packers in the area of liquid accumulation.

It is yet a further objective of the invention to provide a liquid removal system where the gas flow is not subjected to higher resistance due to the presence of the liquid removal tubing string and the cost and complexity of such tubing installation is minimized. In another embodiment of the invention, the string is located outside the main gas production tubing and the entrance is located higher up the well, typically above the packers. In that case, an optional pump may be used to periodically raise the liquid level to the point of tubing string entrance. Since the length of the tubing string is reduced and the tubing string does not go through the packer, the costs of both the tubing material and installation procedure are also minimized.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE FIRST MOST PREFERRED EMBODIMENT OF THE INVENTION

Figure 1A:
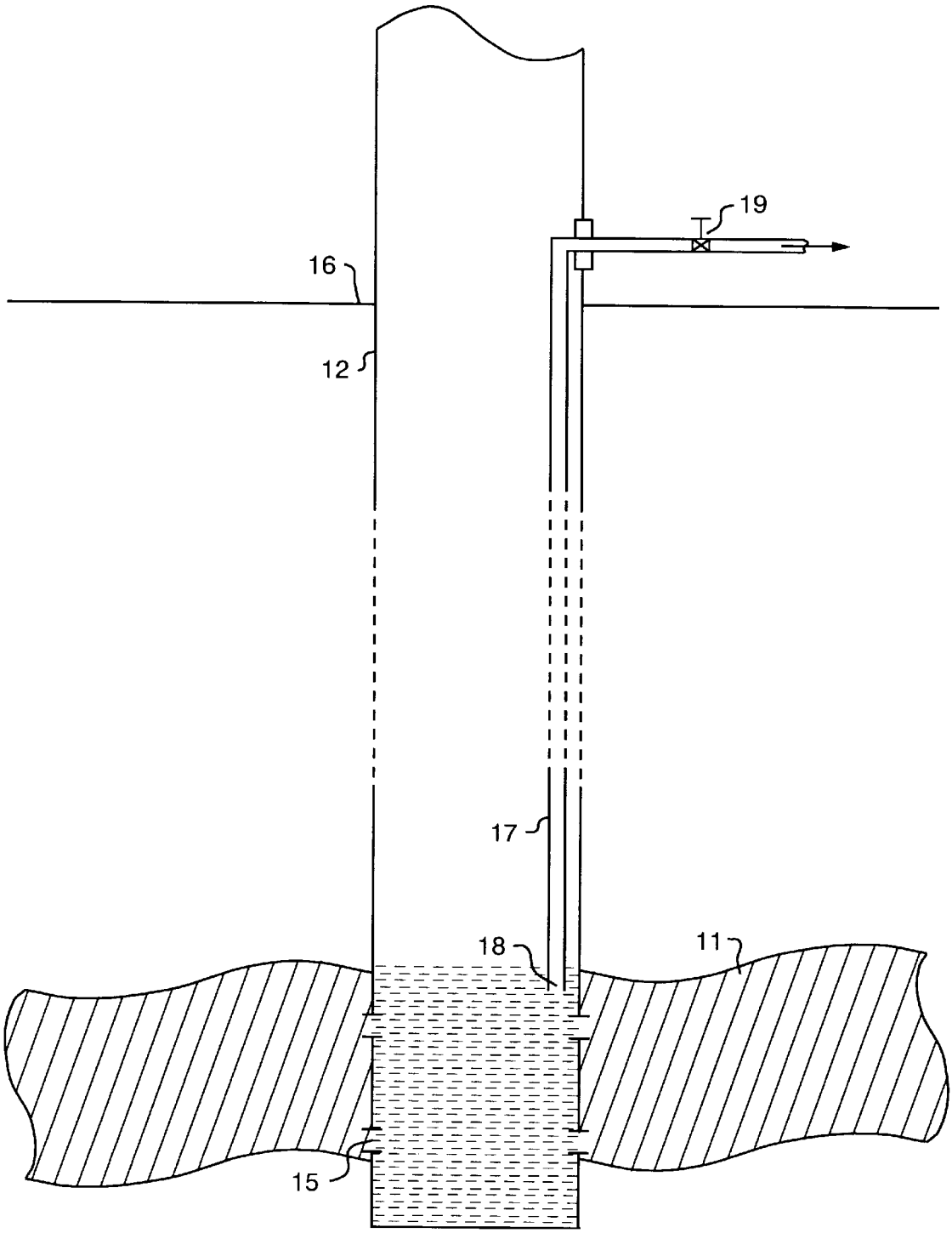
FIGS. 1A and 1B are cross-sectional views of the first most preferred embodiment of the present invention showing a tubing string running down the casing in the optional main gas production tubing to the area of liquid collection at the bottom of the gas well.
Figure 1B:
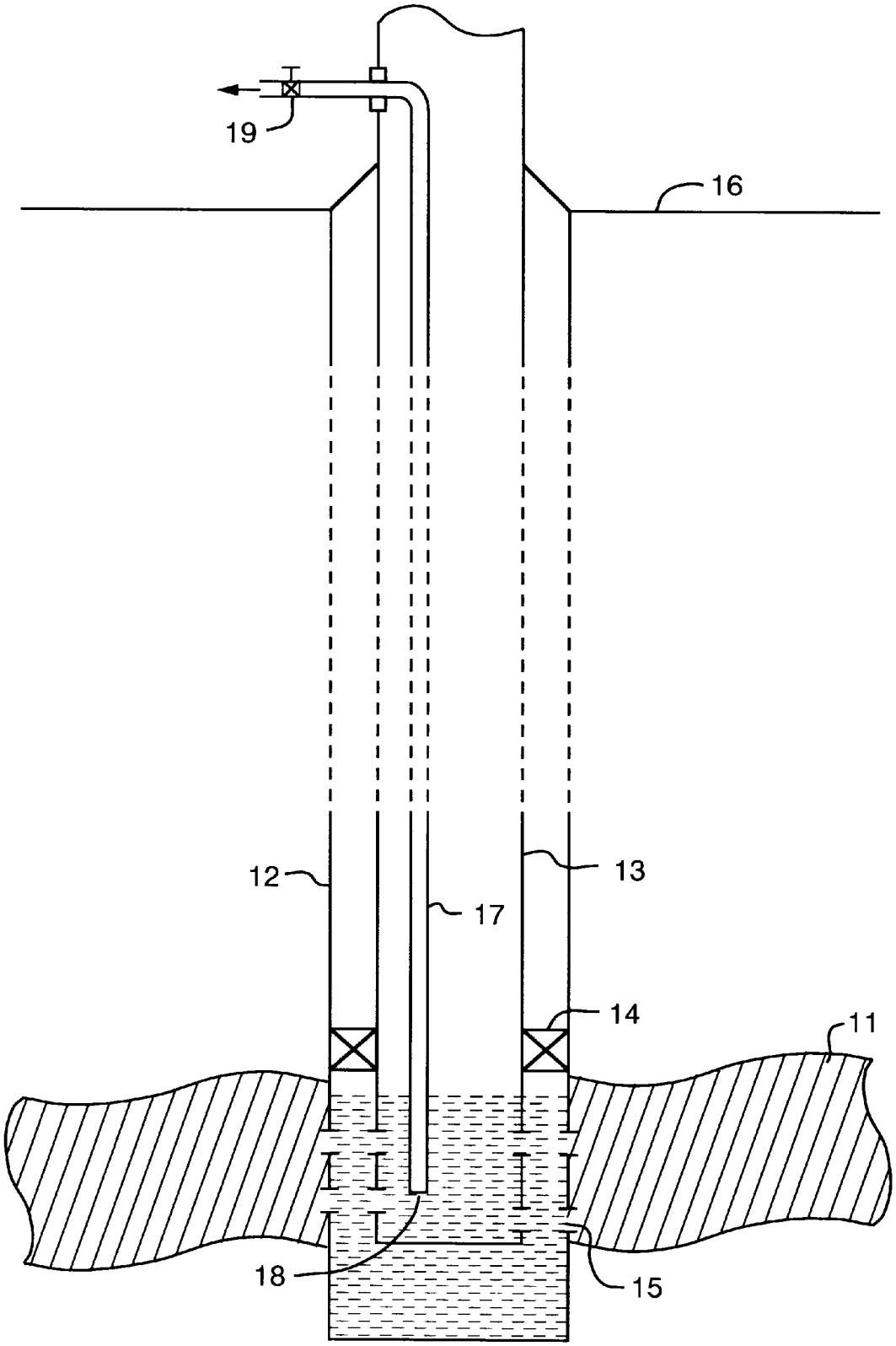

A detailed description of the present invention follows with reference to accompanying drawings in which like elements are indicated by like reference numerals. FIGS. 1A and 1B are cross-sectional views of the first most preferred embodiment of the present invention. A gas well casing (12) with gas entrance perforations (15) is running from the bottom of the gas formation (11) to the ground surface (16). An optional main gas production tubing (13) as shown on FIG. 1B is placed inside the casing (12) and fixed at the bottom in the packers (14). A small diameter tubing string (17) is placed inside the main tubing (13) so as the bottom entrance (18) with an optional filter (not shown) is located in the liquid accumulation zone at the bottom of the well. At the ground surface, the tubing string (17) exits outside the main tubing (13) to atmosphere, liquid collection system, or another appropriate termination point (not shown) through an optional shut-off valve (19) allowing for fine adjustment of the flow rate. Manipulation of the valve (19) together with the valve of the main tubing (13) (not shown) allows to reduce or increase the flow through the tubing string (17) by periodically varying the pressures in both tubing (13) and (17) including even the possibility of occasional closing of the gas flow in the main tubing (13) in order to allow the wellbore pressure to increase, and thus increasing the flow rate and pressure in the tubing string (17).

According to the method of the instant invention, the tubing string (17) serves as a conduit for liquid removal in such a way that in order to maintain high liquid-to-gas ratio, a capillary bubble two-phase flow is developed inside the tubing string (17). The importance of the capillary bubble flow is in the fact that the gas phase cannot travel significantly faster than the liquid phase due to its periodic structure.

The diameter of a vertical, round conduit containing a gas/liquid flow has a great influence on the extent with which the gas phase can slip past the liquid, given its much lower density and viscosity. It can be explained using two hypothetical extremes. At one extreme, one can consider a body of water, such as a lake, with compressed air being introduced from a one inch diameter hose at the bottom. The air will bubble up to the surface with an ever widening cross-sectional area. There is little net flow of water to the surface unless the volume of air is large. At the other extreme, one can consider gas rising through a small diameter pipe inside that same lake. For a given volume of gas introduced continuously at the bottom of the tube, the height of the liquid will increase with incremental decreases in the pipe diameter. This is true whether the flow regime is slug, churn or annular. It is well known in the production of oil to replace the production tubing with one having a smaller diameter in the later stages of the well's free flowing period. A smaller diameter reduces the ability of the gas to slip past the liquid.

There exists a two-phase flow regime where there is no slippage. It has a "periodic structure" where the flow becomes a series of closed systems having alternating layers of liquid and gas. It occurs in tubes of a small diameter and is called "capillary bubble flow". An explanation of this phenomenon is that gas bubbles rising in a liquid seek a specific diameter through a balancing process of coalescence and breakup, given the surface tension of the liquid and the prevailing conditions such as pressure, temperature, etc. At some point, when the tube diameter is less than the bubble diameter, a "periodic structure", or "capillary bubble flow" occurs. Said another way, capillary bubble flow will be formed in tubes with a diameter small enough where the impact of the surface tension dominates the flow conditions. For example, for mixtures of water and air under ambient conditions, capillary bubble flow is established with a tube diameter of 7 millimeters, or 0.276 inches (according to Chisholm, D.: Two-phase Flow in Pipelines and Heat Exchangers. London, New York, G. Godwin in association with The Institution of Chemical Engineers, 1983, page 32).

Another very important characteristic of this "periodic structure" is that the continuity of the liquid phase is broken. As a result, Archimedes forces do not influence the interaction between the phases. This means that at any point in the column, the force of pressure exerted by the gas/liquid flow above will be based on the mass of the liquid, irrespective of its height. In other words, the pressure from above will be reduced by a factor equal to the percentage volume of the flow which is gas.

A valuable result of achieving the capillary bubble flow pattern is that the height of the liquid column, or the hydrostatic head, is much higher than for any other two-phase flow regime experiencing equivalent conditions. Capillary bubble flow will occur in flows having gas volume percentages below 10% and above 90%. As the pressure declines up the well, the gas "period" of the flow will expand while the liquid "period" will stay the same size. Given the absence of slippage and the significant expansion of the gas as the pressure declines up the tubing (the volume doubles each time the hydrostatic pressure is halved—gas volume will expand by a factor of 8 when pressure declines from 1,000 psi to 125 psi), the height of the column can be increased dramatically.

Capillary bubble flow can be considered as having laminar characteristics. The flow regimes replaced by capillary bubble flow (slug flow and chum flow have similar gas/liquid ratios) are typically in the turbulent flow range and are associated with much liquid recirculation. By converting the flow from turbulent to laminar, there is a reduction in the energy consumed which helps offset the energy losses caused by increased wall friction with a smaller diameter. Since the wall surface friction incurred increases by the square of the velocity, friction can be controlled by reducing the flow rate. While friction does effect the liquid flow rate, it does not effect the height of the head. This has positive implications for gas wells where the achievement of a greater head is more important than maximizing flow rate, since the amount that must be produced to evacuate a gas well is relatively small. The flow rate in the small diameter tubes will be based on how high the head is relative to the surface.

A test was performed where compressed air was injected near the bottom of a tall pipe containing water. A pipe circuit was constructed with 2 inch I.D. PVC pipe, and stood 40 feet tall with two columns one foot apart. From the air injection point to the top was 37'7". The water level was set at 10'6". An air compressor delivered ambient air under pressure to the bottom of either of the two columns. An air meter was installed in line that could regulate the volume of air and provide an accurate reading between 0.4 cubic feet per minute (CFM) and 4.0 CFM.

In one column, eight clear vinyl tubes were installed. These tubing segments extend from one foot above the gas injection point, up over the top of the column and down 6 inches of the other column. The vinyl tubing had a ⅜ inch I.D. and a ½ inch O.D. To reduce the size of the air bubbles at the air injection point, a metal screen was used. For comparative tests, a sealed 1 inch O.D. pipe was inserted into the empty 2 inch diameter column to displace the same volume as the plastic walls of the ½ inch vinyl tubing segments in the other column.

At 4.0 CFM of air introduced into the open column with a sealed 1 inch pipe, no water went over the top. It required only 1.3 CFM of air to produce water over the top through the eight vinyl tubes. This was despite the fact that the cross-section area available for flow of the eight little tubes was 28% of the comparable 2 inch diameter pipe, and the air was free to flow outside of the little tubes into the annulus area (50% of the available cross-section).

The two-phase flow pattern for the 2 inch column with a 1 inch pipe inside was a very turbulent flow. Also, the liquid level at the top of the flow followed a cyclical heading pattern where the liquid would easily fall back down the pipe when not supported by the flow below. This is in direct contrast to the flow inside the ⅜ inch I.D. vinyl tubing during comparable tests. A "periodic structure" having sequential layers of gas and liquid was established, and there was no evidence of turbulence. At lower flow rates, there were regular pauses in the vertical flow where the liquid was suspended in the tube. There was little slippage of the liquid back down the small tubes.

As was confirmed in the experiment described above, under typical well pressure and depth conditions, the diameter of the tubing string should be less then about 1 inch and preferably between 1/16 and ½ of an inch. Such a small diameter, by developing a capillary bubble flow starting at the wellbore, will increase the head of the liquid in the tubing string (17), and this head may be high enough to maintain sufficient liquid flow while exiting at pressures equal to the main offtake line downstream of the choke (not shown) used to regulate the gas flow of main tubing (13). This would greatly simplify the design of the liquid removal system at the wellhead since the liquid need not be collected in a tank for later transporting/disposing or pressurized to join the main offlake line. In addition, such a small diameter would permit only a small amount of gas to travel through the tubing string (17) while transporting the liquid towards the ground surface. This factor, in turn, allows for greater flexibility and simplicity in the design of the liquid removal system since it may be feasible to exit the flow straight at atmospheric pressure into a collection tank and dispose of small amounts of gas using conventional techniques. Alternately, a liquid collection and gas separation system, or a system to pressurize the flow for introduction into the main offtake line is also envisioned to be used in some instances (not shown on the drawing).

Although for some wells a single small diameter tubing string may provide enough liquid removal capacity, for some other wells it may be desirable to increase the flow rate of liquid removal. In such case, a plurality of small diameter tubing channels may be used. FIG. 2 illustrates some of these variations.

Figure 2A:
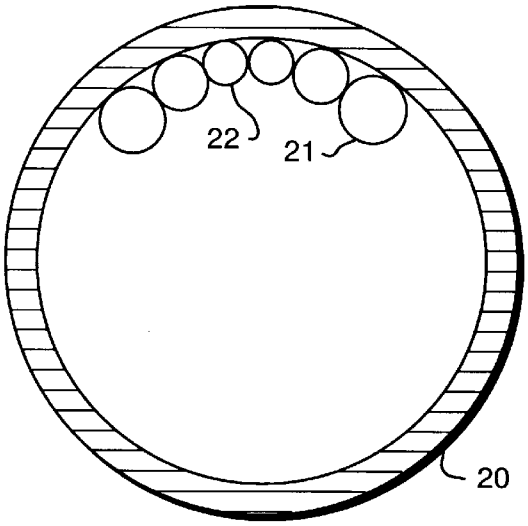
FIGS. 2A through 2D are showing various cross-sectional views of possible arrangements of the tubing string having a plurality of individual tubing channels to increase the liquid removal flow rate.

FIG. 2A shows a plurality of small diameter tubing channels (21) and (22) positioned inside the main gas production tubing (20) and preferably located against its outside wall. Such configuration may have tubing channels of various diameters as shown with channel (21) being larger than channel (22) but still within the size limits described above. Also, it allows for entrance and exit openings of individual channels to be located at different levels along the depth of the well and flow controlled individually which may be beneficial in order to increase the liquid removal rate in case the rate of liquid accumulation increases under a wide spectrum of pressure and flow conditions during the life of the well. Should that occur, more channels can be used for liquid transporting to the ground surface.

Another advantage of having individual control over the small diameter tubing channels is that one or more of these channels may be used to periodically reverse the flow direction and inject a variety of gas or liquid compounds known to be useful in the industry for such injections, an example of such a compound being a foaming agent. This approach will combine several methods utilized for liquid removal or alternately for cleaning, paraffin build-up removal or other purposes.

Figure 2B:
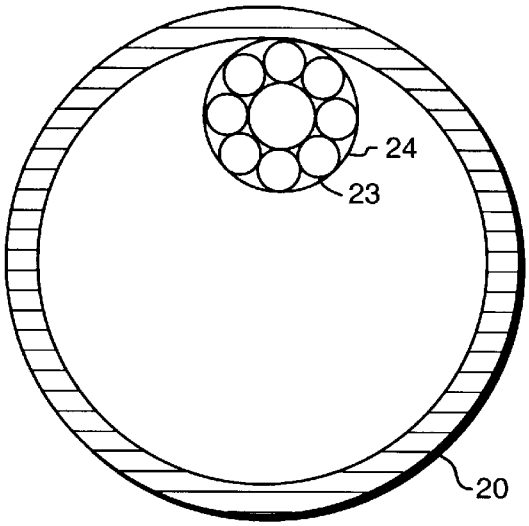

FIG. 2B illustrates another variation of the concept of multiple channel tubing string arrangement. In this version, a plurality of round small diameter tubes (23) are bundled together and may be enclosed in an optional sheath or thin wrapping material (24) placed inside the main tubing (20). Spaces between the round tubes may be plugged off to increase the efficiency of the capillary bubble flow or this space may be used for gas or liquid injection as previously described. Additionally, one or more of the round small diameter tubes (23) may also be used for gas or liquid injection purposes. A header or manifold may be optionally employed for these arrangements at the entrance and also at the exit of such a bundle. The purpose of making the tubing string having a bundle of individual tubes is to further subdivide the two-phase flow through the tubing string into a plurality of smaller yet diameter capillary bubble flows. That subdivision provides for both the capillary bubble flow conditions along at least a portion of each individual tube and at the same time increases the efficiency of liquid removal since the more then one tube is used for liquid transporting.

Figure 2C:
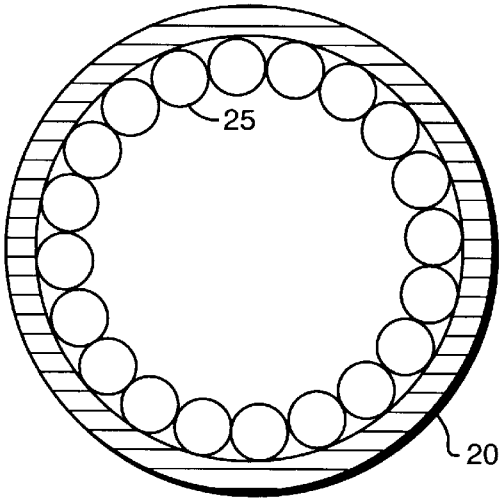
Figure 2D:
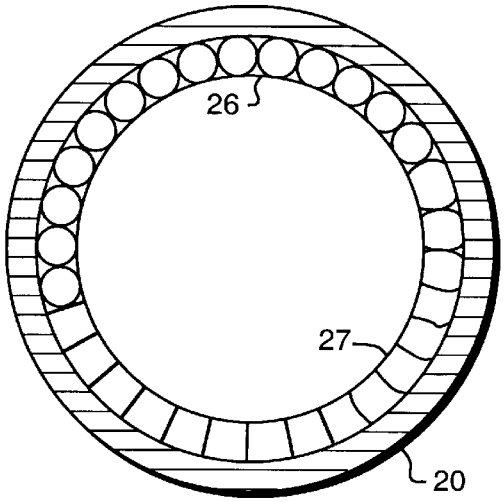

Taking into account fluid dynamics considerations, it is desirable to place individual tubing channels (25) along the outside part or the whole periphery of the main tubing (20) in order to maximize the gas flow rate in the middle as depicted in FIG. 2C. Alternately, FIG. 2D shows that individual tubing channels may have various cross-sectional shapes: round (26) or non-round, for example semi-squared (27) in order to utilize better the round geometry of the main tubing (20). It will be apparent to those skilled in the art that other shapes and arrangements of the multiple channel tubing system may be utilized that would satisfy the requirements of the main principle of the instant invention, namely that the flow conditions should be such as to provide for high liquid-to-gas ratio, preferably for capillary bubble flow in the liquid removal system. Such arrangements may include a variable cross-sectional area and shape along the length of each individual tubing channel. Alternately, the tubing string may not be designed as multiple tubing segments joined together but rather unrolled from a coil and lowered into the well as used in other well known applications where a tubing string is disposed inside the gas well for injecting of various compounds.

DETAILED DESCRIPTION OF THE SECOND EMBODIMENT OF THE INVENTION

Figure 3:
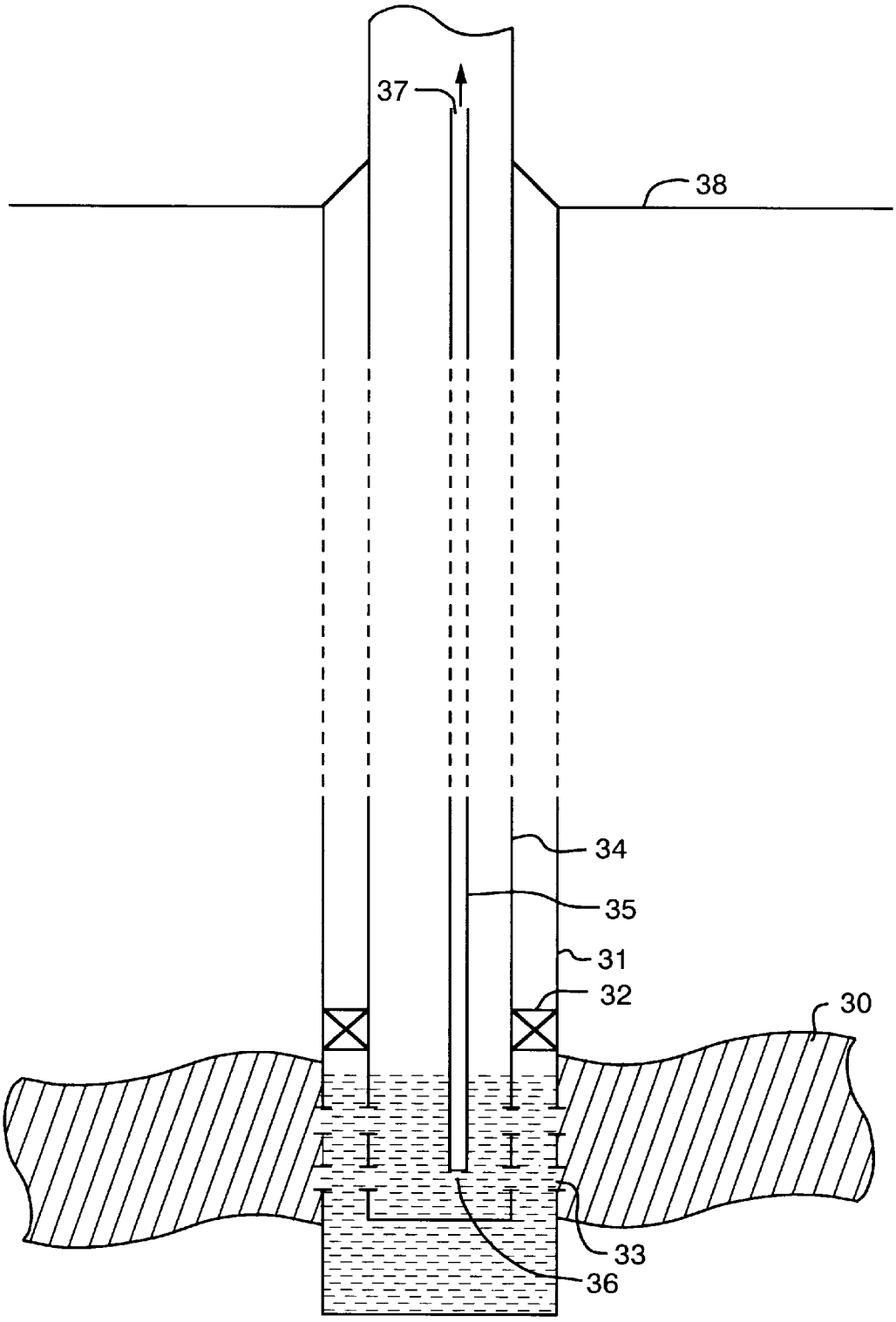
FIG. 3 illustrates a cross-section of the second embodiment of the invention in which a tubing string provides a parallel pathway for the liquid removal system to flow upstream under the conditions of capillary bubble flow.

FIG. 3 illustrates a cross-sectional view of the second embodiment of the present invention. A gas well casing (31) with perforations (33) connects the gas formation (30) up to the ground surface (38) and typically contains the main gas production tubing (34) placed in the packers (32) near the bottom of the well. The tubing string (35) provides a flow pathway for liquid removal. It is designed in a similar way as in the first embodiment of the instant invention including the option of having various multiple channel arrangements described above. The main difference is that both the entrance (36) and the exit (37) of the tubing string (35) are contained within the main tubing (34). This allows for a simpler configuration of the system where the liquid is drained into the top of the main gas production tubing (34) which flows directly to the offtake line for possible further separation. The purpose of the tubing string (35) is to provide a parallel pathway in such a way that a capillary bubble flow conditions would be developed and increase the head of the liquid compared to the flow in a larger diameter tubing, thus allowing the liquid to be lifted to the wellhead.

DETAILED DESCRIPTION OF THE THIRD PREFERRED EMBODIMENT OF THE INVENTION

One of the objects of the present invention is to minimize the reduction in gas production typically caused by the presence of the liquid removal tubing string. There are two ways that this additional resistance is reduced according to the method of the invention. Firstly, the total cross-sectional area of the liquid removal system is reduced because of the higher liquid-to-gas ratio as compared with the prior art systems. Secondly, as illustrated on FIGS. 4 and 5, in accordance with the third embodiment of the invention, most or all of the small diameter tubing string may be placed outside the main gas production tubing so as to be contained in the annulus space between the main gas production tubing and the well casing. In that case, the restriction associated with its presence is minimized or totally eliminated allowing for higher levels of gas production flow.

Figure 4:
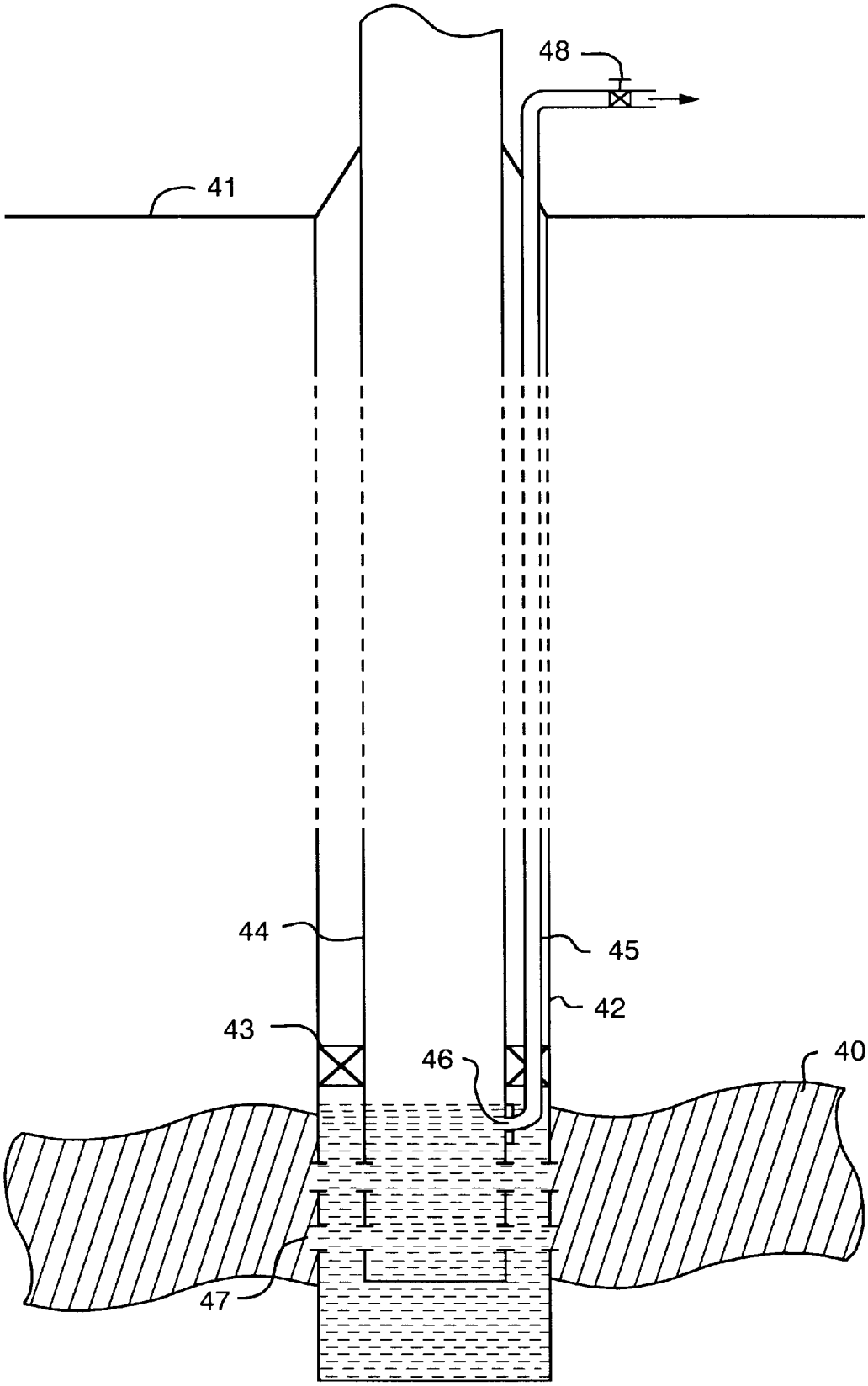
FIG. 4 is an cross-sectional illustration of a third embodiment of the invention where the tubing string is located externally to the main gas production tubing so as not to restrict the gas flow.

FIG. 4 shows one of the arrangements in accordance with the third embodiment of the invention. A typical gas well casing (42) with gas perforations (47) is installed to provide a gas pathway from the gas formation (40) to the ground surface (41) and into the offtake line (not shown). The main gas production tubing (44) is placed inside the casing (42) and fixed within packers (43). The liquid removal tubing string (45) is placed externally to the main tubing (44). It runs in the annulus of the casing (42) and through the packers (43) so as to have an entrance opening (46) in the bottom of the well where liquid accumulation is likely to occur. Alternately, entrance opening (46) may be placed in the annulus between the casing (42) and the main gas production tubing (44) (not shown on the drawing). On the ground surface, the tubing string (45) has an optional valve (48) and may terminate in the similar way as described for the first embodiment of the present invention.

As would be appreciated by those skilled in the art, this arrangement would eliminate any possible additional gas resistance since no part of the tubing string (45) is contained in the main gas production tubing (44) to resist the gas flow.

Figure 5:
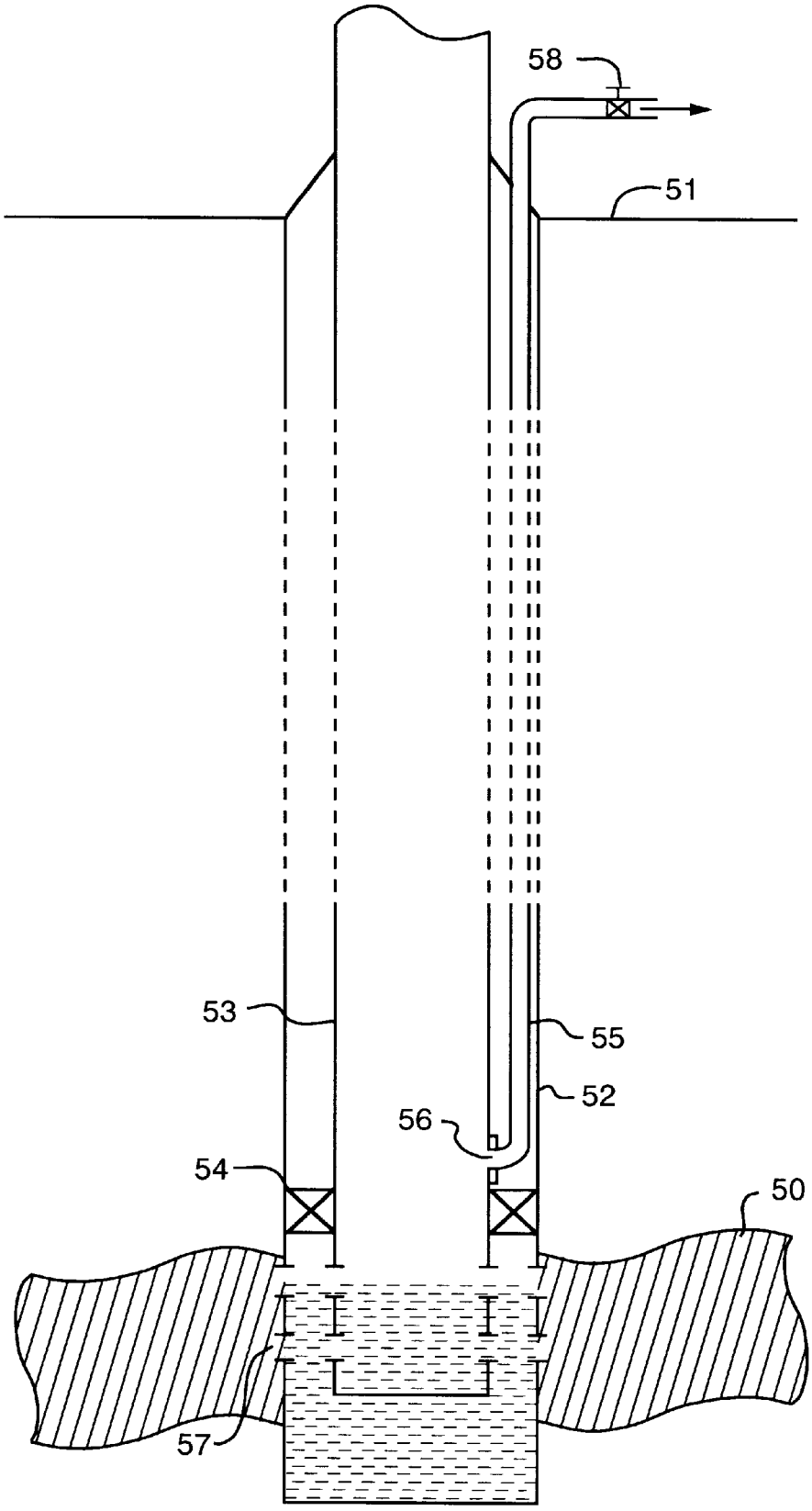
FIG. 5 is showing a cross-sectional view of a variation of the third embodiment where the entrance of the tubing string is located higher up the well casing in order to reduce production costs; and finally

Alternately, FIG. 5 illustrates another typical gas well casing (52) with gas perforations (57) being installed to provide a gas pathway from the gas formation (50) to the ground surface (51) and into the offtake line (not shown on the drawing). The main gas production tubing (53) is again placed inside the well casing (52) and fixed within packers (54). The liquid removal tubing string (55) runs outside the main tubing (53) in the annulus of the casing (52) but this time its entrance opening (56) is located in the higher section of the well and above packers (54). In this case, one or possibly a plurality of entrance openings (56) placed at different depths may be plumbed in advance to accommodate the connection of the tubing string (55) externally to the main gas production tubing (53). On the ground surface, the tubing string (55) has an optional valve (58) and may terminate in the similar way as described for the previous embodiments of the present invention. As was done for the second embodiment, the term "tubing string" is used for description of the third embodiment to include all variations depicted for the first embodiment of the invention.

The arrangement of the tubing string (55) would again reduce or totally eliminate the restriction caused by the presence of the liquid removal system. At the same time, it may be more economical to employ the system illustrated on FIG. 5 due to the reduced length of the tubing string (55) and easier installation associated with it. At the same time and under some pressure conditions, higher placement of entrance (56) may require the use of additional conventional pump (not shown) designed to raise periodically the level of liquid in the well up to the entrance (56) in order to facilitate the liquid removal process.

DETAILED DESCRIPTION OF THE FOURTH EMBODIMENT OF THE INVENTION

Figure 6A:
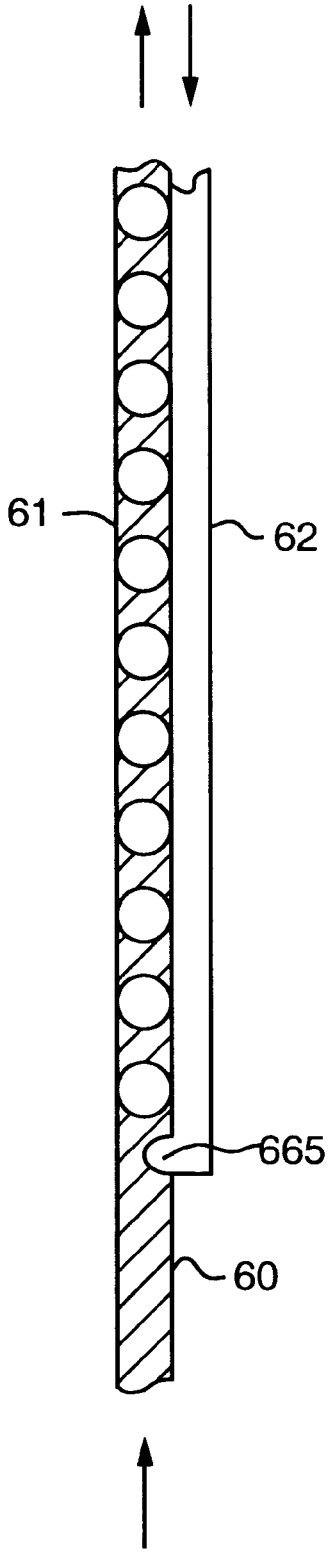
FIGS. 6A and 6B illustrate a fourth embodiment of the invention where a liquid removal tubing string contains an injection port for injecting of gas for additional lifting energy to the liquid or, alternately, injection of liquid to control paraffin or scale buildup.
Figure 6B:
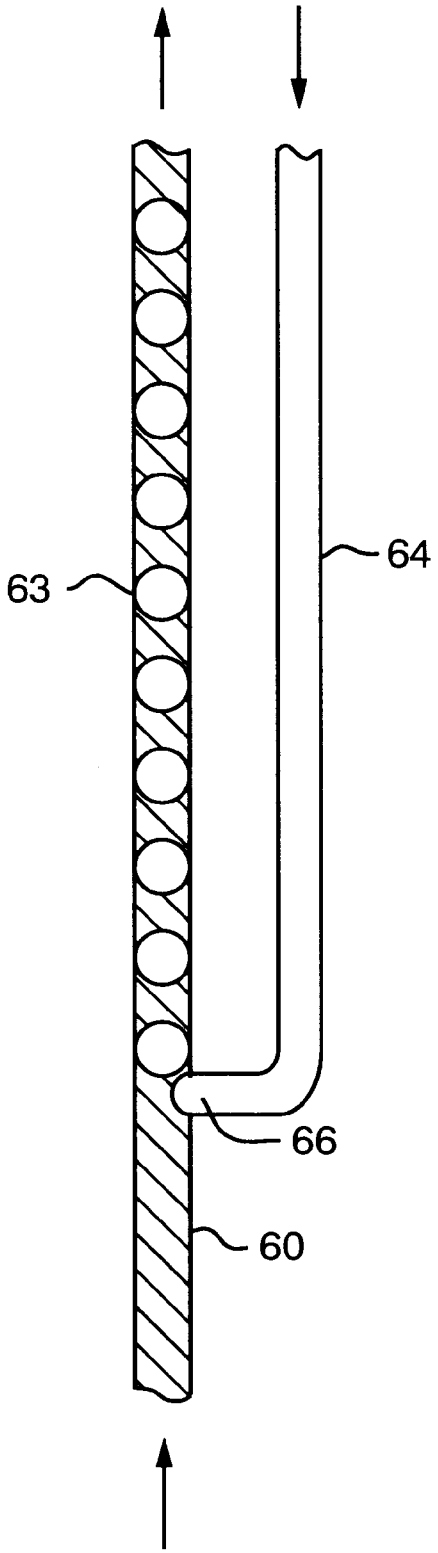

FIGS. 6A and 6B illustrate liquid removal tubing string according to the fourth embodiment of the present invention which is designed to boost up the liquid removal process in wells with reduced pressure. In such a case, it is proposed to have at least one injection port along the liquid removal tubing string to inject additional gas into the flowing stream of gas and liquid. This would produce additional bubbles that would increase the lifting capacity of the system.

Alternately, a liquid can be injected through the injection port to control any possible buildup of solids such as paraffin buildup, scale, and the like that can limit the rate of liquid removal. This liquid may be a surfactant agent, a foaming agent, or a descaling agent as previously discussed.

FIG. 6A shows the first version of such a device in which the liquid removal tubing string (60) contains an injection port (65). Additional gas or liquid is injected from the injection tubing (62) into the section (61) of the tubing string (60) which is located above the port (65). In this case, tubing (62) is placed adjacent to the tubing (60). Alternately, as shown on FIG. 6B, injection tubing (64) may be placed separately from the section (63) of the tubing (60) located above the injection port (66).

Although the present invention has been described with respect to several specific embodiments and applications, it is not limited thereto. Numerous variations and modifications readily will be appreciated by those skilled in the art and are intended to be included within the scope of the present invention, which is recited in the following claims.

What we claim is:

1. A device for removal of a production inhibiting liquid from a gas well, said gas well having a casing defining a first fluid communication path from a gas formation zone to an offtake line for main gas production, said device comprising a tubing string for liquid removal, said tubing string disposed inside of said casing and defining a second fluid communication path from a liquid accumulation zone to a ground surface for removal of said liquid, said liquid accumulation zone generally located near the bottom of the gas formation zone, wherein the size of said tubing string being sufficiently small so as to define a high liquid-to-gas ratio two-phase flow along said second fluid communication path, said flow being a capillary bubble flow along at least a portion of said second fluid communication path.

2. A device as in claim 1, wherein said tubing string having a dedicated shut-off valve to adjust the pressure and flow of said high liquid-to-gas ratio two-phase flow along said second fluid communication path.

3. A device as in claim 1, the shape of said tubing string is round and the diameter of said tubing string being generally less then 1 inch.

4. A device as in claim 2, wherein the diameter of said tubing string being in the range between 1/16 and ½ inch.

5. A device as in claim 1, wherein said tubing string having a plurality of individual tubing channels, said channels further subdividing said high liquid-to-gas ratio two-phase flow for efficient liquid removal.

6. A device according to claim 5, wherein said individual tubing channels having various diameters of less then about 1 inch to cover a variety of pressure conditions over the life of said gas well.

7. A device according to claim 5, wherein said tubing channels being bundled together.

8. A device according to claim 5, wherein said tubing channels being bundled together in a sheath.

9. A device as in claim 5, wherein said tubing channels having a shape other then round to better utilize the space available inside the gas well.

10. A device as in claim 1, wherein said well further comprising a main gas production tubing disposed inside said casing, and said tubing string disposed externally to said main gas production tubing, whereby the resistance to gas flow generally associated with the presence of said tubing string being substantially reduced.

11. A device as in claim 10, wherein said tubing string having a plurality of individual tubing channels, each channel defining a high liquid-to-gas ratio two-phase flow and having entrance at various depths along said well.

12. A device as in claim 11, further comprising conventional pumping means, said means utilized for periodical raising of the liquid level up to the entrance of said individual tubing channels.

13. A device as in claim 1, wherein said liquid removal tubing further comprises an injection port for injecting of gas to form additional bubbles inside the liquid removal tubing, whereby increasing its liquid removal capacity.

14. A device as in claim 1, wherein said liquid removal tubing further comprises an injection port for injecting of liquid to control a buildup of solids along said liquid removal tubing, said solids limiting the liquid removal capacity of said liquid removal tubing.

15. A method for removal of production inhibiting liquid from a gas well, said gas well having a casing defining a first fluid communication path from a gas formation zone to an offtake line for main gas production, said method comprising disposing of a tubing string for liquid removal inside of said casing, said tubing string defining a second fluid communication path from a liquid accumulation zone to a ground surface for removal of said liquid, said liquid accumulation zone generally located near the bottom of the gas formation zone, wherein the size of said tubing string being sufficiently small so as to define a high liquid-to-gas ratio two-phase flow along said second fluid communication path, said flow being a capillary bubble flow along at least a portion of said second fluid communication path.

* * * * *